US010979812B2

(12) United States Patent
Dyrholm et al.

(10) Patent No.: US 10,979,812 B2
(45) Date of Patent: Apr. 13, 2021

(54) HEADSET WITH AMBIENT NOISE REDUCTION SYSTEM

(71) Applicants: GN Audio A/S, Ballerup (DK); Mads Dyrholm, Ballerup (DK); Allan Mejlgren Von Bülow, Ballerup (DK)

(72) Inventors: Mads Dyrholm, Ballerup (DK); Allan Mejlgren Von Bulow, Ballerup (DK)

(73) Assignees: GN AUDIO A/S, Ballerup (DK); Mads Dyrholm, Ballerup (DK); Allan Mejlgren Von Bülow, Ballerup (DK)

( * ) Notice: Subject to any disclaimer, the term of this patent is extended or adjusted under 35 U.S.C. 154(b) by 0 days.

(21) Appl. No.: 16/954,123

(22) PCT Filed: Dec. 7, 2018

(86) PCT No.: PCT/EP2018/084010
§ 371 (c)(1),
(2) Date: Jun. 16, 2020

(87) PCT Pub. No.: WO2019/115397
PCT Pub. Date: Jun. 20, 2019

(65) Prior Publication Data

US 2020/0382870 A1 Dec. 3, 2020

(30) Foreign Application Priority Data

Dec. 15, 2017 (DK) ..... PA201700717

(51) Int. Cl.
*H04R 25/00* (2006.01)
*H04R 5/033* (2006.01)
(Continued)

(52) U.S. Cl.
CPC ..... *H04R 5/033* (2013.01); *G10L 21/0232* (2013.01); *H04R 1/1083* (2013.01);
(Continued)

(58) Field of Classification Search
CPC .... H04R 5/033; H04R 1/1083; G10L 21/0232
See application file for complete search history.

(56) References Cited

U.S. PATENT DOCUMENTS

2007/0088544 A1* 4/2007 Acero ..... G10L 21/02 704/226
2010/0280824 A1* 11/2010 Petit ..... H04R 3/04 704/214

(Continued)

OTHER PUBLICATIONS

International Search Report and Written Opinion issued in PCT/EP2018/084010, dated Mar. 18, 2019.

*Primary Examiner* — Simon King
(74) *Attorney, Agent, or Firm* — Hamre, Schumann, Mueller & Larson, P.C.

(57) ABSTRACT

A headset adapted to transmitting an outgoing audio signal (Tx) and comprising a voice microphone and at least one ambient microphone. The headset comprises an ambient noise reduction block (ANR), which is adapted to reduce the level of ambient noise in the outgoing audio signal (Tx). The ambient noise reduction block (ANR) includes the measuring the levels of the voice microphone signal (X) and ambient microphone signal (Y) to estimate a characteristic constant level drop between the voice microphone signal (X) and the ambient microphone signal (Y), which is characteristic for the headset user talking. A time-varying filter passes the voice microphone signal (X), when the level difference is larger than characteristic constant level drop (CLD) and attenuates the voice microphone signal (X), if the level difference is below characteristic constant level drop.

12 Claims, 7 Drawing Sheets

(51) Int. Cl.
*G10L 21/0232* (2013.01)
*H04R 1/10* (2006.01)
*G10L 21/0216* (2013.01)

(52) U.S. Cl.
CPC ..... *G10K 2210/1081* (2013.01); *G10L 2021/02165* (2013.01); *H04R 2460/01* (2013.01)

(56) References Cited

U.S. PATENT DOCUMENTS

2014/0172421 A1* 6/2014 Liu ..... H04R 1/1083
704/227
2014/0288927 A1 9/2014 Klug
2015/0110278 A1* 4/2015 Andersen ..... H04R 25/407
381/56
2015/0163602 A1* 6/2015 Pedersen ..... H04R 25/43
381/315
2016/0105755 A1* 4/2016 Olsson ..... H04R 1/1083
381/71.6
2016/0381453 A1* 12/2016 Ushakov ..... H04R 1/1033
381/71.6
2018/0146307 A1* 5/2018 Petersen ..... H04R 25/407

* cited by examiner

| | Normal position | Bad position |
|---|---|---|
| |  |  |
| 2-mic | $\frac{Y_{User}}{X_{User}} < \frac{Y_{Noise}}{X_{Noise}}$ | $\frac{Y_{User}}{X_{User}} \approx \frac{Y_{Noise}}{X_{Noise}}$ |
| 3-mic | $\frac{Y_{User}}{X_{User}} \ll \frac{Y_{Noise}}{X_{Noise}}$ | $\frac{Y_{User}}{X_{User}} < \frac{Y_{Noise}}{X_{Noise}}$ |

HEADSET WITH AMBIENT NOISE REDUCTION SYSTEM

TECHNICAL FIELD

The invention related to a headset adapted to transmitting an outgoing audio signal, the headset comprises a voice microphone generating a voice microphone signal, at least one ambient microphone generating an ambient microphone signal , wherein, when the headset is worn by a user, the voice microphone is arranged at a first distance from the users mouth, and the ambient microphone is arranged at a second distance from the users mouth, wherein the first distance is smaller than the second distance.

BACKGROUND ART

A headset of type mentioned above can be provided with earphones or earbuds and used for listening to audio, such as music, and two-way communication. It can be corded and plugged into a smartphone or computer, or it can be wireless and be provided with a transceiver, such as a Bluetooth transceiver. Other types of headsets comprise two earphones, a headband connecting the earphones and a microphone arm, by means of which the microphone can be arranged close to the user's mouth during use. It is a great advantage to be able to arrange the microphone close to the mouth, as a better signal to ambient noise ratio can be obtained. This is why this type of headset is the most widely used headset for telecommunication in call centres and offices. When a user is using such a headset for two-way communication, ambient noise, such as speak from other office workers in the office can be problematic. Firstly, the noise can be transmitted to the other end together with the headset user's voice, which can be disturbing. Secondly, communication in the office, which may be confidential, may reach the party at other end of the communication line, which, off course, is undesirable. Thus, there is a need to provide an improved ambient noise reduction system for headsets.

DISCLOSURE OF INVENTION

The headset according to the preliminary part comprises an ambient noise reduction block, which is adapted to reduce the level of ambient noise in the outgoing audio signal, wherein the ambient noise reduction block includes the following steps:

I. detecting that the headset user is talking,

II. measuring the levels of the voice microphone signal and ambient microphone signal to estimate a characteristic constant level drop between the voice microphone signal and the ambient microphone signal, which is characteristic for the headset user talking, III. constructing a time-varying filter for removing noise, IV. detecting a level difference between the voice microphone signal and the ambient microphone signal, V. comparing the level difference between the voice microphone signal and the ambient microphone signal with the characteristic constant level drop, VI. the time-varying filter passes the voice microphone signal, when the level difference is larger than characteristic constant level drop, VII. the time-varying filter attenuates the voice microphone signal, if the level difference is below the characteristic constant level drop.

With such a headset, the level of ambient noise in the signal transmitted form the headset can efficiently be removed. The steps listed above are taking place continuously, which means multiple times per second, in practice up to 250 times per second. It is important that the system is continuously adaptive because the exact positioning of the microphones relative to the user's mouth is continuously changing: First of all due to anatomical variations when the headset is worn by different users; secondly, due to the degrees of freedom in the positioning of the headset on the individual user; and thirdly, due to animations of the user such as turning the head and thereby changing the exact position of the mouth relative to the microphone geometry and/or changing the microphone system's geometry itself.

According to an embodiment, the steps I.-VII. are taking place continuously.

According to an embodiment, the steps I.-VII. are taking place multiple times per second.

According to an embodiment, the steps I.-VII. are taking place more than 100 times per second.

According to an embodiment, the steps I.-VII. are taking place more than 200 times per second.

According to an embodiment, the voice microphone signal and the ambient microphone signal are separated into a number of frequency bands, e.g. 65 bands.

According to an embodiment, a fast Fourier transform algorithm transforms the voice microphone signal and the ambient microphone signal into the frequency domain before reaching the ambient noise reduction block and where an inverse Fourier transform algorithm transforms the Tx signal into the time domain. Other filter banks may be used.

The at least one ambient microphone may be an active noise cancellation microphone.

The headset may comprise a microphone arm, wherein the voice microphone is located at the free end of the microphone arm.

According to an embodiment, the headset comprises a right ambient microphone generating a right ambient microphone signal and a left ambient microphone generating a left ambient microphone signal, wherein, when the headset is worn by a user, the right ambient microphone and the left ambient microphone both are arranged at the second distance from the users mouth, wherein the ambient microphone signal received by the ambient noise reduction block is the difference between one of the first and second ambient microphone signals and an attenuated version of the other of the first and second ambient microphone signals.

The attenuated version of the first or the second ambient microphone signal may be attenuated between 3 dB and 9 dB, preferably approximately 6 dB.

According to an embodiment, the right ambient microphone and the left ambient microphone are symmetrically arranged on each side of the sagittal plane when the headset is worn.

According to an embodiment, the headset comprises a first earphone or earbud and a second earphone or earbud, wherein the right ambient microphone is located at the first earphone/earbud and the left ambient microphone is arranged at the second earphone/earbud.

According to an embodiment, the headset comprises a first earbud and a second earbud and a connection part connecting the first and the second earbud, the connection part comprises a neck part, which is adapted to be worn around the neck between a first neck part end and a second neck part end, and where a first cable part extends between the first neck part end and the first earbud and a second cable part extends between the second neck part end and the second earbud, where a microphone box is arranged on the first cable part between the first neck part end and the first earbud, such that a first cable element of the first cable part extends between the first neck part end and the microphone box and a second cable element of the cable part extends between the microphone box and the first earbud, and wherein the connection part is adapted such that first neck band end points in a first direction, when the headset is worn, and wherein the first cable element has a first cable element length and a first cable element flexibility and the second cable element has a second cable element length and a second cable element flexibility, characterised in that the first earbud, the first direction, the first cable element length, the first cable element flexibility, the second cable element length, the second cable element flexibility are adapted such that the microphone box will be located at a first distance the mouth of a user when worn, which first distance is less than 8 cm.

The voice microphone may be an omnidirectional microphone.

BRIEF DESCRIPTION OF THE DRAWINGS

The invention is explained in detail below with reference to the drawing illustrating a preferred embodiment of the invention and in which.

MODES FOR CARRYING OUT THE INVENTION

Figure 1:
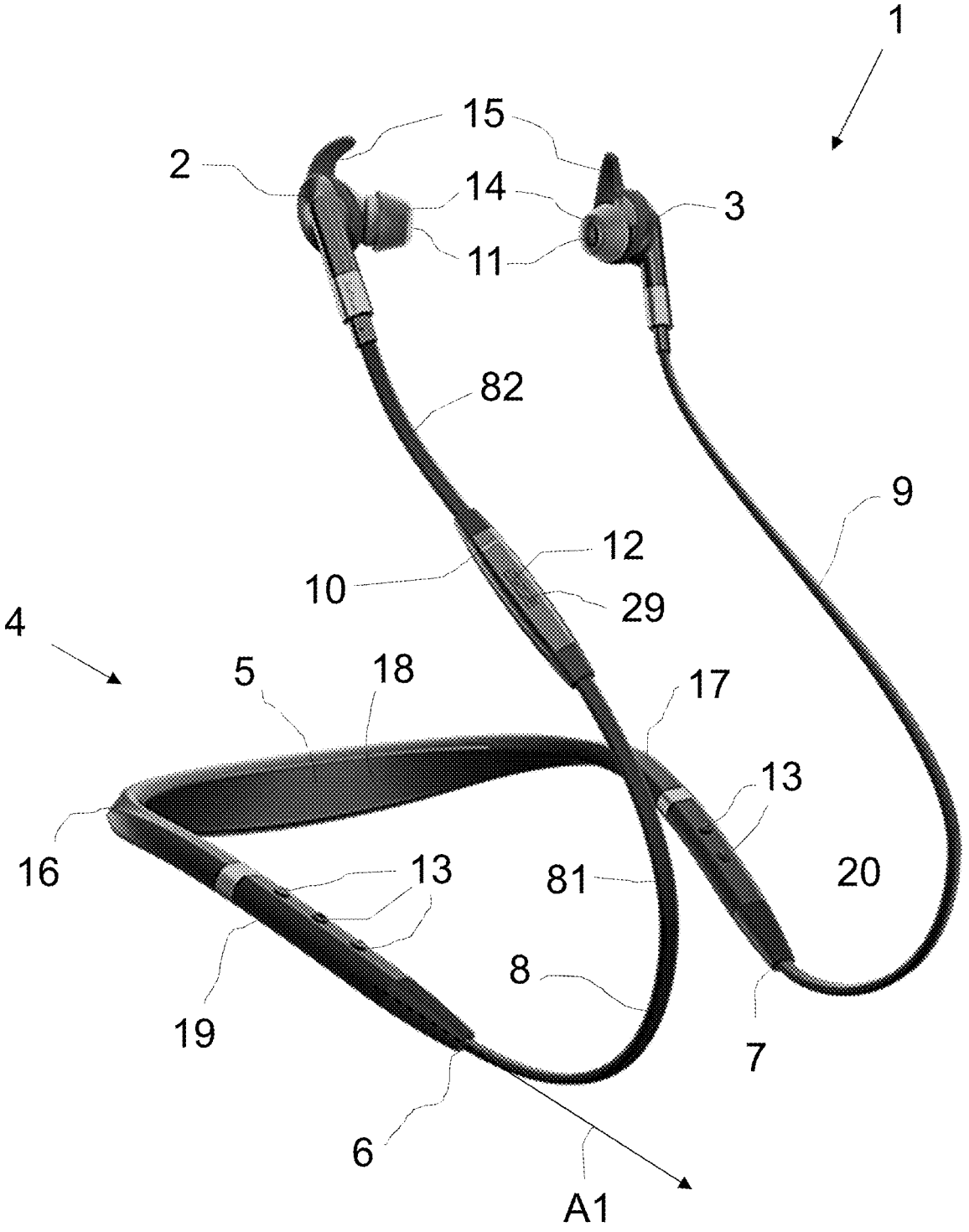
FIG. 1 is a perspective view of a headset according to a first embodiment.

FIG. 1 is a perspective view of a headset. The headset is a wireless headset of the earbud type, which means that it is provided with small earbuds to be inserted into the ear of a user. Thus, it comprises a first earbud 2 to be inserted into the right ear and a second earbud 3 to be inserted into the left ear. The first and second earbuds 2, 3 are interconnected by a connection part 4. The connection part 4 comprises a neck part 5 with a first neck part end 6 and a second neck part end 7, a first cable part 8 connecting the first neck part end 6 with the first earbud 2 and a second cable part 9 connecting the second neck part end 7 with the second earbud 3. The first cable part 8 is divided into a first cable element 81, a microphone box 10 with a voice microphone 12 and a second cable element 82. The neck part 5 comprises a main part 18 to be arranged behind the user's neck, a right arm 19 to lie on the right side of the user's neck and a left arm 20 to lie on the left side of the user's neck during use. The main part 18 and the arms 19, 20 are unbendable. A first flexible neck part bend 16 connects the main part 18 with the right arm 19 and a second neck part bend 17 connects the main part 18 with the left arm 20. In relaxed condition, the right arm points inwards and downwards in a direction Al. When a user wears the headset, the neck will press the arms away from each other. Both right and left arms are provided with control buttons 13 for volume control, accept call, dial, power on/off, Bluetooth pairing etc.

A rechargeable battery is arranged in the main part 18. The electronics including a Bluetooth transceiver are mainly arranged in the right and left arm. An omnidirectional microphone 12 is arranged in the microphone box 10. Microphone openings 29 provide acoustic access from the ambient to the voice microphone 12. The headset comprises an ANC (acoustic noise cancelling) system and comprises a first ambient microphone 21 in the first earbud 2 and a second ambient microphone in the second earbud 3. Each of the first and second earbuds 2, 3 comprises an eargel 14 with a sound outlet 11 and an "ear wing" 15 to lie against the conchal wall of the user's ear.

Figure 2:
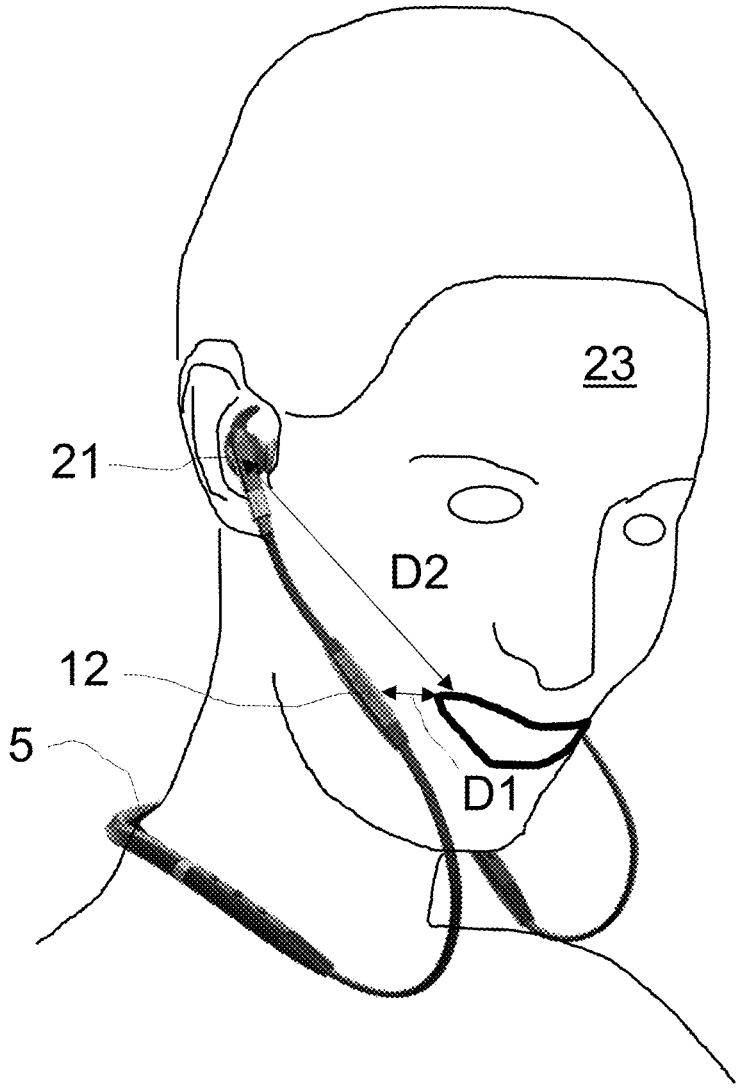
FIG. 2 is a perspective view of the headset worn by a user.

FIG. 2 is a perspective view of the headset 1 worn by a user 23. The neck part 5 is arranged around the neck of the user 23 and the first and second earbuds 2, 3 are inserted into the ears of the user 23. Due to the specific geometry, dimensions and materials chosen for the neck part 5, the first cable part 8, the microphone box 10 with the voice microphone 12, it is ensured that a first Distance D1 between the microphone openings 29 and the user's mouth is not more than 80 mm. This is important if a good signal to noise ratio is to be obtained in environments with background noise. The voice microphone 12 is an omnidirectional microphone.

Figure 3:
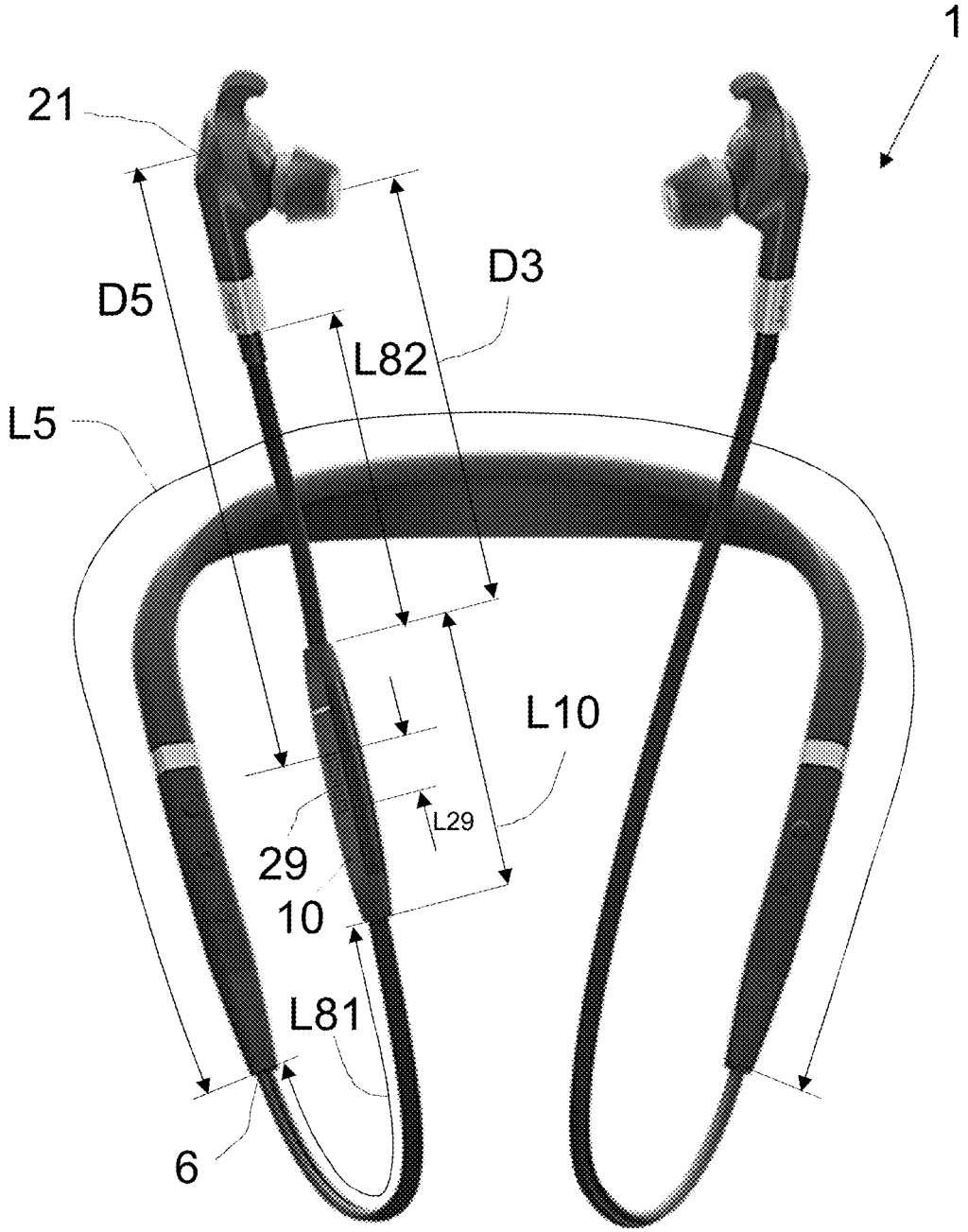
FIG. 3 is a perspective view of the headset from another angle.

FIG. 3 is a perspective view of the headset from another angle. The total length L5 of the neck part 5 is 393 mm. The length of the first cable element 81 is 83 mm and the length L82 of the second cable element 82 is 100 mm. The length L10 of the microphone box 10 is 45 mm. The distance D3 between the eargel 14 and the microphone box is 100 mm. The cable 8 has a thickness of 2 mm and a width of 3.6 mm. A matrix of microphone openings 29 has a length L29 of 10 mm and is arranged halfway along the microphone box 10. The first cable element 81 leaves the first end 6 of the neck part 5 with one of its wide sides facing the user's body and one of the narrow sides facing the user's neck. In this way, the position of the microphone box 10 is better controlled. The microphone openings 29 always points forward and upward when the headset 1 is worn.

Figure 4:
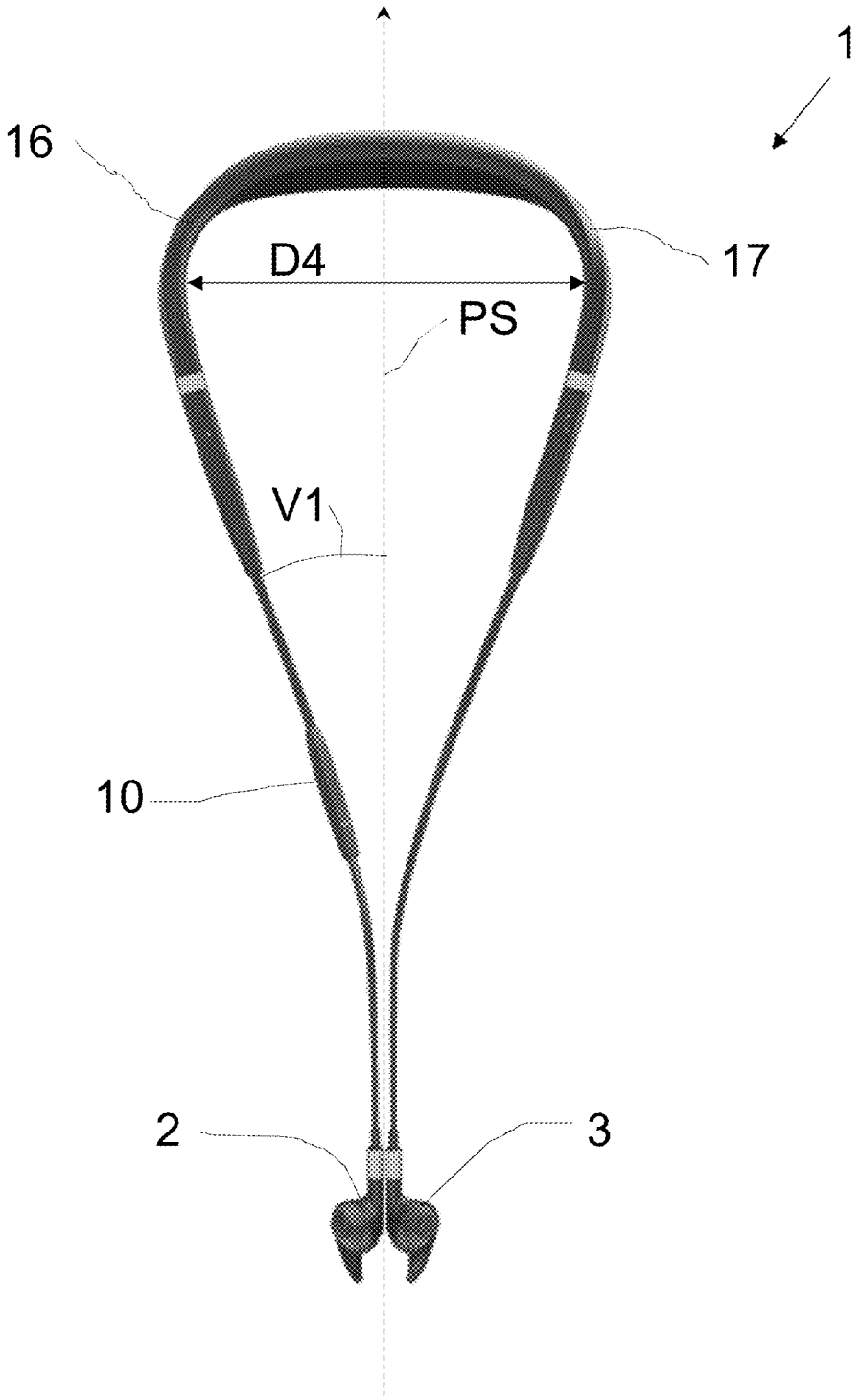
FIG. 4 is a forward view of the headset in "non-use" position.

FIG. 4 is a forward view of the headset in "non-use" or "relaxed" position. The widest distance D4 between neck part bends 16, 17 is 128 mm. The angle V1 between the sagittal plane PS and the pointing direction is approximately 20 degrees. The first and second earbuds 2, 3 are held together by magnetic force.

Figure 7:
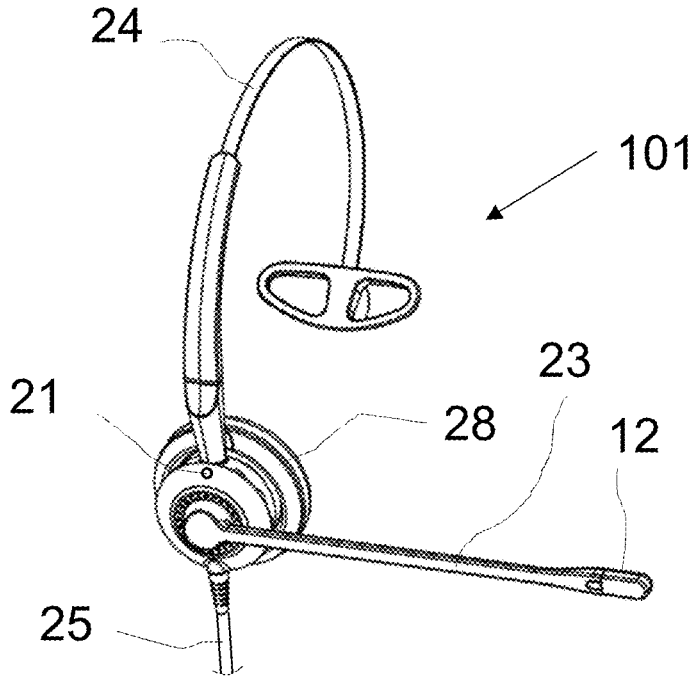
FIG. 7 is a perspective view of a headset according to a second embodiment.

FIG. 7 is a perspective view of a headset 101 according to a second embodiment. This headset 101 comprises an earphone 28, a headband 24, a microphone arm 23, a voice microphone 12 in the outer end of the microphone arm 24, an ambient microphone 21 at the earphone 28 and a cable 25 pending from the earphone 28. This headset is a monaural headset with only one earphone 28. According to an alternative embodiment the headset could be a duo-headset with two earphones 28 with an ambient microphone 21 arranged at each earphone 28.

Figure 8:
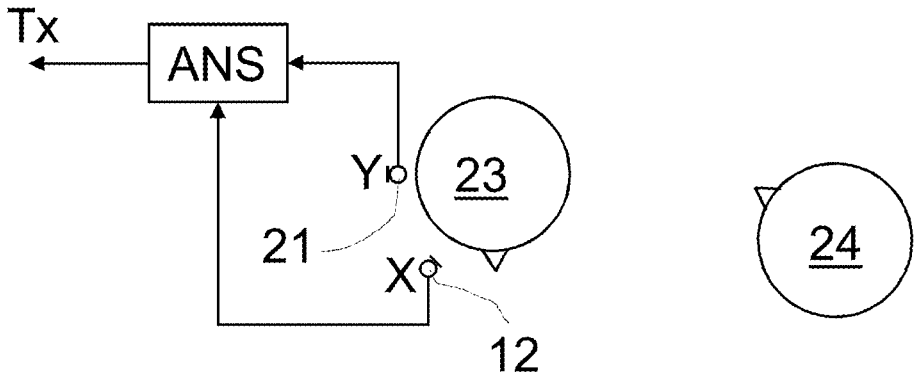
FIG. 8 is a schematic view of a microphone system of the headset shown in FIG. 7.

FIG. 8 is a schematic view of a microphone system of the headset 101 shown in FIG. 7. A voice microphone signal X from the voice microphone 12 and an ambient microphone signal Y from the ambient microphone 21 are directed to an ambient noise reduction system ANS. When the user 23 speaks, the voice will cause both the voice microphone 12 and the ambient microphone 21 to generate signals. As the voice microphone 12 is closer to the mouth, the voice microphone signal X will be stronger than and coherent with the ambient microphone signal Y from the ambient microphone 21. More distant sounds, such as the voice from another person 24 at a distance from the headset user 23, will also cause both microphones 12, 21 to generate signals. However, the sound from the distant person 24 and other distant sound sources generates more equal signal levels from the voice microphone 12 and the ambient microphone 21. Both signals are fed to the ambient noise reduction system ANS, and the ambient noise reduction system ANS can to some degree filter away sounds from distant sources and pass the headset user's voice.

The difference between the voice microphone signal $X_K$ and the ambient microphone signal $Y_K$ is used as indication that the signal in frequency bin k is predominantly the user voice.

Figure 5:
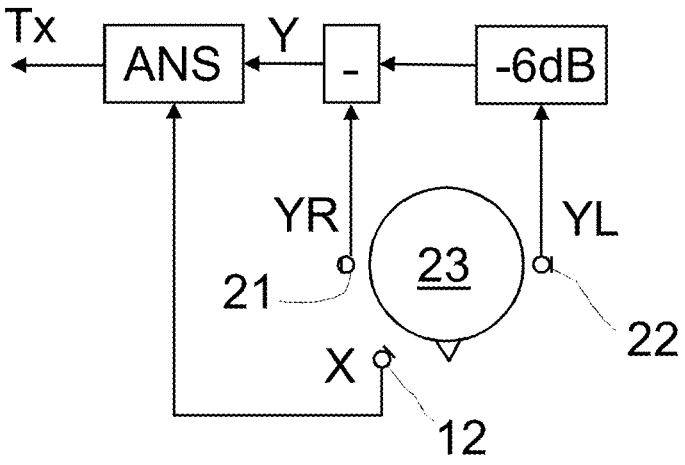
FIG. 5 is a schematic view of a microphone system of the headset shown in FIGS. 1-4.

FIG. 5 is a schematic view of a microphone system of the headset shown in FIGS. 1-4. As earlier mentioned the headset comprises a voice microphone 12, a first ambient microphone 21 and a second ambient microphone 22. The voice microphone 12 is arranged in the microphone box 10 along the first cable part 8. The first ambient microphone 21 is arranged in the right earbud 2 and the second ambient microphone 22 is arranged in the left earbud 3. An audio signal X from the voice microphone 12 and an ambient microphone signal Y from the ambient microphones 21, 22 are directed to the ambient noise reduction system ANS. The ambient microphone signal Y is the ambient microphone signal YR form the right ambient microphone 21 subtracted a 6 dB attenuated ambient microphone signal YL from the left ambient microphone 22. This microphone system is more advanced than the microphone system of the second embodiment shown in FIG. 8. By using two ambient microphones and subtracting a part of one of the ambient microphone signals from the other, a greater level difference between the voice microphone signal X and the modified ambient microphone signal Y can be obtained. If the full left ambient microphone signal was subtracted from the right ambient microphone signal or vice versa, an even greater difference would be obtained. Theoretically, this would create a nulling plane that attenuates the user voice to zero (infinite magnitude drop). However, a zeroing of the user voice would remove the coherence between the voice microphone signal X and the ambient microphone signal Y and the ambient noise reduction can therefore not function in this manner. Therefore, the left ambient microphone signal YL is attenuated 6 dB. Thus, a 6 dB attenuation plane is created instead of a zeroing plane which still amplifies the contrast between user voice and ambient noise while at the same time keeping coherence between voice microphone signal X and the ambient microphone signal Y, when the user talks. Another attenuation of e. g. 3 dB or 9 dB could be used. However, 6 dB has shown to provide a very good compromise between the obtaining high level difference or signal level drop from the voice microphone signal to the ambient microphone signal and still preventing the risk of creating of a zeroing plane.

Figure 6:
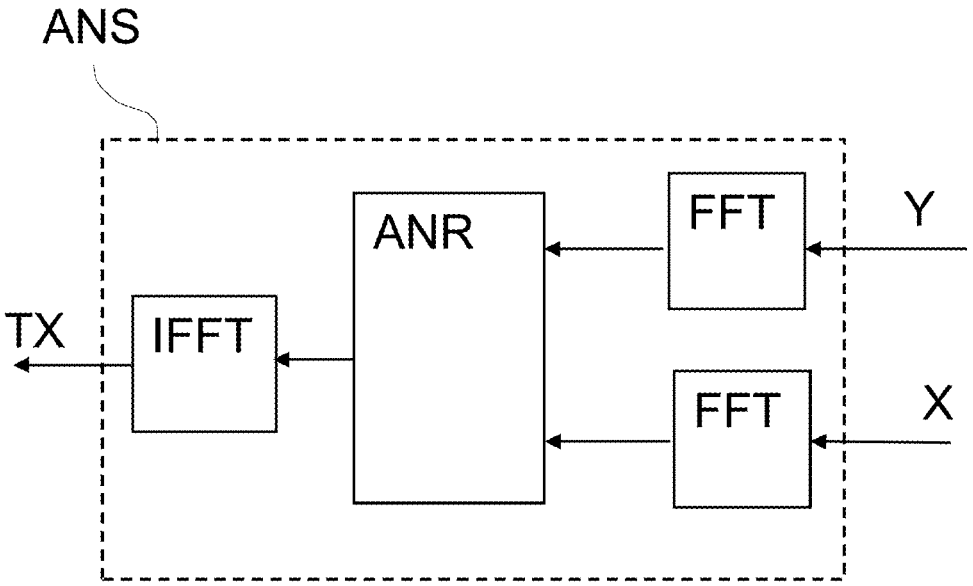
FIG. 6 is a schematic view of an ambient noise system of the headset shown in FIGS. 1-4.

FIG. 6 is a schematic view of an ambient noise reduction system ANS of the headset 1 shown in FIGS. 1-4. The ambient noise reduction system ANS comprises Fast Fourier Transformation FFT of the voice microphone signal X and the ambient microphone signal Y into the frequency domain. It should be noted, that other filter banks could be used to separate the signals into frequency bands. Hereafter, the signals X, Y are sent to an ambient noise reduction block ANR, in which the following four steps takes place:

Microphone Adaption:

Running estimate of the expected sound pressure level SPL magnitude drop when the user is talking.

If and how much the estimate is adjusted, depends on:

1) The instantaneous sound pressure level on the voice microphone is higher than some set level.
2) The instantaneous sound pressure level on the voice microphone is some set level higher than the average noise measured on the voice microphone.
3) A short term average of the coherence between the voice microphone signal X and the ambient microphone signal Y is higher than a long term best coherence between the microphone signals within a tolerance.

Noise reduction Gain Calculation:

An NR (noise reduction) gain per frequency band is calculated based on the estimate. A measured frequency band exhibiting less difference in magnitude than expected between the voice microphone 12 and the ambient microphone(s) 21, 22 translates into a corresponding attenuation.

Noise Reduction Boosting and Smoothing

Boosts noise reduction in frequency bands where it is assessed to have limited impact on headset user's speech.

Boosts noise reduction in all bands based on the certainty that the headset user is not speaking.

Smoothes across frequency bands depending on the certainty that the headset user is not speaking.

NR Limiter

Calculates how much noise reduction is allowed per frequency band, based on the difference between static noise and the headset user's average speech level.

Figure 9:
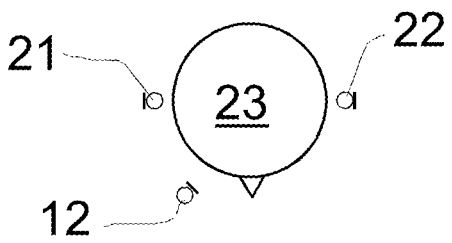
FIG. 9 is a table illustrating differences between the microphone systems shown in FIGS. 5 and 8.
Figure 9:
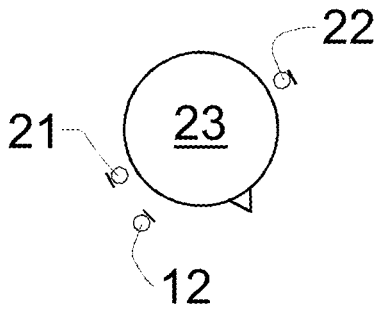

FIG. 9 is a table illustrating differences between the microphone systems shown in FIGS. 5 and 8 in two different situations. The second row shows for the 2-microphone solution shown in FIG. 8, the relations between the ambient microphone signal Y and the voice microphone signal X for a situation where the voice microphone 12 is placed close to the mouth in an optimal position and for a situation where the voice microphone 12 is displaced to a non-optimal position. In both positons the ambient noise creates the same signal level for the voice microphone and the ambient microphone, whereby the fraction $Y_{Noise}/X_{Noise}=1$. In the optimal position the signal level caused by the user's voice are much higher for the voice microphone 12 than for the ambient microphone 21, whereby the fraction $Y_{User}/X_{User}<1$. Hence $Y_{User}/X_{User}<Y_{Noise}/X_{Noise}$. For the the non-optimal position shown in the third column, there is only a little signal level difference between the voice microphone 12 and the ambient microphone 31 caused by the user's speech, as they are both positioned far from the mouth. Thus $Y_{User}/X_{User}\approx Y_{Noise}/X_{Noise}\approx 1$. For the 3-microphone system of FIG. 5 shown in the third row the following applies: In the optimal position of the voice microphone, signal level difference between the voice microphone signal X and the ambient microphone signal Y due to the user's speech is in most cases much higher than the difference between the signal levels caused by ambient noise. Even in a non-optimal position for the voice microphone as shown in the third column, the level difference between the voice microphone and the ambient microphones caused by the user's speech is still essentially higher than the level difference caused by ambient noise. Thus, the 3-microphone solution is less sensitive to a non-optimal position of the voice microphone.

REFERENCE SIGNS

A1 pointing direction of first neck part end
ANS ambient noise reduction system ANR ambient noise reduction block
D1 first distance (between voice microphone and mouth)
D2 second distance (between ambient microphone and mouth)
D3 third distance (between ear canal and mic box)
D4 widest distance between neck part bends
D5 distance between voce microphone and first ambient microphone
V1 angle between Al and PS
PS sagittal plan
L5 length of neck part
L10 length of microphone box
L81 first cable element length
L82 second cable element length
F81 first cable part flexibility
F82 second cable part flexibility
X voice microphone signal
Y ambient microphone signal
YR right ambient microphone signal
YL left ambient microphone signal
1 headset
2 first earbud
3 second earbud
4 connection part
5 neck part
6 first neck part end
7 second neck part end
8 first cable part
9 second cable part
10 microphone box
11 sound outlet
12 voice microphone
13 control buttons
14 eargel
15 earwing
16 first neck part bend
17 second neck part bend
18 main part of neck part
19 right arm of neck part
20 left arm of neck part
21 right ambient microphone
22 left ambient microphone
23 microphone arm
24 headband
25 cable
26 user
27 noise maker
28 earphone
29 microphone openings
81 first cable element
82 second cable element

The invention claimed is:

1. A headset adapted to transmitting an outgoing audio signal, the headset comprises:

a) a voice microphone generating a voice microphone signal (X), b) at least one ambient microphone generating an ambient microphone signal (Y), wherein, when the headset is worn by a user, the voice microphone is arranged at a first distance (D1) from the users mouth, and the ambient microphone is arranged at a second distance (D2) from the users mouth, wherein the first distance (D1) is smaller than the second distance (D2), a right ambient microphone generating a right ambient microphone signal (YR) and a left ambient microphone generating a left ambient microphone signal (YL), c) an ambient noise reduction block (ANR), which is adapted to reduce the level of ambient noise in the outgoing audio signal (Tx), wherein the ambient noise reduction block (ANR) includes the following steps:

I. detecting that a headset user is talking,

II. measuring the levels of the voice microphone signal (X) and ambient microphone signal (Y) to estimate a characteristic constant level drop between the voice microphone signal (X) and the ambient microphone signal (Y), which is characteristic for the headset user talking, III. constructing a time-varying filter for removing noise, IV. detecting a level difference between the voice microphone signal (X) and the ambient microphone signal (Y), V. comparing the level difference between the voice microphone signal (X) and ambient microphone signal (Y) with the characteristic constant level drop, VI. the time-varying filter passes the voice microphone signal (X), when the level difference is larger than characteristic constant level drop (CLD), VII. the time-varying filter attenuates the voice microphone signal (X), if the level difference is below the characteristic constant level drop, VIII. wherein, when the headset is worn by a user, the right ambient microphone and the left ambient microphone both are arranged at the second distance (D2) from the users mouth, wherein the ambient microphone signal (Y) received by the ambient noise reduction block (ANR) is the difference between one of the first and second ambient microphone signals (YR) and an attenuated version (YL') of the other of the first and second ambient microphone signals (YR, YL).

2. A headset according to claim 1, wherein the steps 1.-VII. are taking place continuously.

3. A headset according to claim 2, wherein the steps 1.-VII. are taking place multiple times per second.

4. A headset according to claim 3, wherein the steps 1.-VII. are taking place more than 100 times per second.

5. A headset according to claim 1, wherein the voice microphone signal (X) and the ambient microphone signal (Y) are separated into a number of frequency bands.

6. A headset according to claim 5, wherein a fast Fourier transform algorithm transforms the voice microphone signal (X) and the ambient microphone signal (Y) into the frequency domain before reaching the ambient noise reduction block (ANR) and where an inverse Fourier transform algorithm transforms the Tx signal into the time domain.

7. A headset according to claim 6, wherein the attenuated version (YL') of the first or the second ambient microphone signal is attenuated between 3dB and 9dB, preferably approximately 6dB.

8. A headset according to claim 7, wherein the right ambient microphone and the left ambient microphone are symmetrically arranged on each side of the sagittal plane when the headset is worn.

9. A headset according to claim 6, wherein the headset comprises a first earphone and a second earphone wherein the right ambient microphone is located at the first earphone and the left ambient microphone is arranged at the second earphone.

10. A headset according to claim 1 wherein the at least one ambient microphone is an active noise cancellation microphone.

11. A headset according to claim 1, wherein the headset comprises a microphone arm, wherein the voice microphone is located at the free end of the microphone arm.

12. A headset adapted to transmitting an outgoing audio signal, the headset comprises:

a) a voice microphone generating a voice microphone signal (X), b) at least one ambient microphone generating an ambient microphone signal (Y), wherein, when the headset is worn by a user, the voice microphone is arranged at a first distance (D1) from the users mouth, and the ambient microphone is arranged at a second distance (D2) from the users mouth, wherein the first distance (D1) is smaller than the second distance (D2), a first ambient microphone generating a right ambient microphone signal (YR) and a second ambient microphone generating a left ambient microphone signal (YL), c) an ambient noise reduction block (ANR), which is adapted to reduce the level of ambient noise in the outgoing audio signal (Tx), wherein the ambient noise reduction block (ANR) includes the following steps:

I. detecting that a headset user is talking,

II. measuring the levels of the voice microphone signal (X) and ambient microphone signal (Y) to estimate a characteristic constant level drop between the voice microphone signal (X) and the ambient microphone signal (Y), which is characteristic for the headset user talking, III. constructing a time-varying filter for removing noise, IV. detecting a level difference between the voice microphone signal (X) and the ambient microphone signal (Y), V. comparing the level difference between the voice microphone signal (X) and ambient microphone signal (Y) with the characteristic constant level drop, VI. the time-varying filter passes the voice microphone signal (X), when the level difference is larger than characteristic constant level drop (CLD), VII. the time-varying filter attenuates the voice microphone signal (X), if the level difference is below the characteristic constant level drop, VIII. wherein, when the headset is worn by a user, the first ambient microphone and the second ambient microphone both are arranged at the second distance (D2) from the user's mouth, wherein the ambient microphone signal (Y) received by the ambient noise reduction block (ANR) is the difference between one of the first and second ambient microphone signals (YR) and an attenuated version (YL') of the other of the first and second ambient microphone signals (YR, YL).

* * * * *